US008896404B2

(12) United States Patent
Won et al.

(10) Patent No.: US 8,896,404 B2
(45) Date of Patent: Nov. 25, 2014

(54) COIL COMPONENT AND METHOD OF MANUFACTURING THE SAME

(75) Inventors: Jae Sun Won, Gyunggi-do (KR); Deuk Hoon Kim, Gyunggi-do (KR); Geun Young Park, Gyunggi-do (KR); Young Min Lee, Gyunggi-do (KR); Dae Young Hwang, Gyunggi-do (KR); Jong Hae Kim, Gyunggi-do (KR); Myeong Jeong Kim, Seoul (KR); Jeong Myeon Kim, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 13/449,040

(22) Filed: Apr. 17, 2012

(65) Prior Publication Data

US 2013/0154782 A1 Jun. 20, 2013

(30) Foreign Application Priority Data

Dec. 20, 2011 (KR) ..... 10-2011-0138143

(51) Int. Cl.

| | |
|---|---|
| ***H01F 27/30*** | (2006.01) |
| ***H01F 27/29*** | (2006.01) |
| ***H01F 27/28*** | (2006.01) |
| ***H01F 27/26*** | (2006.01) |
| ***H01F 27/24*** | (2006.01) |
| ***H01F 27/04*** | (2006.01) |

(52) U.S. Cl.

USPC ..... 336/198; 336/192; 336/196; 336/182; 336/184; 336/210

(58) Field of Classification Search

CPC ... H01F 27/325; H01F 27/306; H01F 27/292; H01F 5/02; H01F 38/10

USPC ..... 336/198, 196, 192, 182, 184, 210, 220, 336/221

See application file for complete search history.

(56) References Cited

U.S. PATENT DOCUMENTS

| | | | | |
|---|---|---|---|---|
| 5,793,273 | A * | 8/1998 | Yamaguchi et al. | 336/198 |
| 6,320,492 | B1 * | 11/2001 | Kubomura et al. | 336/213 |
| 6,927,650 | B2 * | 8/2005 | Okamoto | 333/181 |
| 7,772,957 | B2 * | 8/2010 | Chen et al. | 336/208 |
| 2008/0211616 | A1 * | 9/2008 | Suzuki et al. | 336/182 |
| 2011/0221559 | A1 * | 9/2011 | Tsai et al. | 336/192 |

FOREIGN PATENT DOCUMENTS

| | | |
|---|---|---|
| JP | 1-89719 | 6/1989 |
| JP | 6-086317 A | 3/1994 |
| JP | 09-283354 A | 10/1997 |
| JP | 2010-109727 A | 5/2010 |

OTHER PUBLICATIONS

Korean Office Action issued in Korean Patent Application No. 10-2011-0138143, mailed on Dec. 20, 2012, with English translation.

Korean Office Action issued in Application No. 10-2011-0138143 dated May 22, 2013.

Korean Office action issued in Application No. 10-2011-0138143 dated Nov. 22, 2013.

* cited by examiner

*Primary Examiner* — Alexander Talpalatski

*Assistant Examiner* — Kazi Hossain

(74) *Attorney, Agent, or Firm* — McDermott Will & Emery LLP

(57) ABSTRACT

There are provided a coil component and a method of manufacturing the same. The coil component includes a core; at least one bobbin coupled to the core and having a coil wound therearound; and a base having the core seated therein and including an external connection terminal, wherein one side of the core is seated in the bobbin and the other side thereof is exposed to the outside of the base.

12 Claims, 11 Drawing Sheets

COIL COMPONENT AND METHOD OF MANUFACTURING THE SAME

CROSS-REFERENCE TO RELATED APPLICATIONS

This application claims the priority of Korean Patent Application No. 10-2011-0138143 filed on Dec. 20, 2011, in the Korean Intellectual Property Office, the disclosure of which is incorporated herein by reference.

BACKGROUND OF THE INVENTION

1. Field of the Invention

The present invention relates to a coil component and a flat panel display device including the same.

2. Description of the Related Art

A switching mode power supply (SMPS) is generally used as a power supply for electric and electronic devices such as a display device, a printer, or the like.

The SMPS, a module type power supply converting electricity supplied from the outside so as to meet various electric and electronic devices such as a computer, a television (TV), a video cassette recorder (VCR), a switchboard, a wireless communications device, and the like, serves to perform switching control at a high frequency, higher than a commercial frequency, and stabilizes an output by using semiconductor switching characteristics.

This SMPS generally includes a line filter in order to improve electromagnetic interference (EMI). The line filter is a coil component in which a coil is wound around a core. As a line filter included in the SMPS according to the related art, a toroidal-type or troidal-type line filter has mainly been used.

EMI may be divided into conducted emissions and radiated emissions, each of which may be again classified into differential mode EMI and common mode EMI.

Individual common mode line filters (for example, chock coils) need to be used in a live line and a neutral line of power input lines in order to remove the common mode EMI, and at least one differential mode line filter (for example, a chock coil) needs to be separately used in order to remove the differential mode EMI.

However, a volume of the SMPS may be increased due to the chock coil for removing the above-mentioned EMI, such that customer demand for product slimness and lightness may not be satisfied. In particular, the SMPS cannot be easily used for slim electronic devices.

Further, in the case of the line filter (for example, the chock coil) according to the related art, since an insulating bobbin is assembled with a toroidal core, and two coils are wound around the bobbin in opposing directions, automated production is not possible, such that production speed may be relatively low, thereby causing an increase in manufacturing costs.

SUMMARY OF THE INVENTION

An aspect of the present invention provides a coil component capable of easily being automatedly manufactured and a method of manufacturing the same.

Another aspect of the present invention provides a coil component having a coil wound therearound in a state in which a bobbin, a core, and a base are assembled together and a method of manufacturing the same.

Another aspect of the present provides a thin coil component capable of easily being used for slim electronic devices and a method of manufacturing the same.

According to an aspect of the present invention, there is provided a coil component, including: a core; at least one bobbin coupled to the core and having a coil wound therearound; and a base having the core seated therein and including an external connection terminal, wherein one side of the core is seated in the base and the other side thereof is exposed to the outside of the base.

The bobbin may include: a tubular body part having a through hole formed therein; and flange parts protruded to the outside from both ends of the body part, wherein an outer surface of any one of the flange parts is provided with a gear and the gear is exposed to the outside of the base.

The base may include: a core receiving groove in which one side of the core is seated; a bobbin receiving groove in which the bobbin is received; and a stumbling protrusion protruded from an opposite side of the core receiving groove to support the other side of the core.

When the bobbin is received in the bobbin receiving groove, the flange part formed with the gear may be exposed to the outside of the base.

The base may include a terminal fastening part formed at an outer edge and fastened to the external connection terminal.

The terminal fastening part may include at least one lead groove guiding the coil to the external connection terminal.

The terminal fastening part may be disposed within a vertical range formed by a diameter of the bobbin.

The base may include: a side wall forming an outer contour of the core receiving groove; and a terminal fastening part formed at the outside of the side wall and fastened to the external connection terminal.

The terminal fastening part may be disposed within a horizontal range formed by a diameter of the bobbin.

Two of the bobbins may be coupled to the core, and the base may be formed with two bobbin receiving grooves corresponding to the two bobbins.

The base may include a blocking protrusion protruded while crossing the bobbins between the two bobbin receiving grooves.

The stumbling protrusion may support a center of the other side of the core exposed between the two bobbins.

According to another aspect of the present invention, there is provided a coil component, including: a core; at least one bobbin coupled to the core, having a coil wound therearound, and a gear formed at one end thereof; and a base having the core seated thereon and including a terminal fastening part fastened to an external connection terminal, wherein the bobbin is disposed so that the gear is exposed to the outside of the base and the terminal fastening part is disposed within a vertical range formed by a diameter of the bobbin.

According to another aspect of the present invention, there is provided a coil, including a coil component, including: a core; at least one bobbin coupled to the core and including a winding part having a coil wound therearound and a gear formed at one end of the winding part; and a base including a bobbin receiving groove receiving the winding part and the other end of the bobbin.

According to another aspect of the present invention, there is provided a coil, including a method of manufacturing a coil component, including: coupling a bobbin having a gear formed at one end thereof to a core; coupling the core coupled to the bobbin with a base; disposing an assembly including the bobbin, the core and the base assembled with one another, in an automatic winding apparatus; and winding a coil around the bobbin by using the automatic winding apparatus.

The coupling of the core with the base may include coupling the core with the base so that the bobbin gear is exposed to the outside of the base.

The disposing of the assembly in the automatic winding apparatus may include disposing the assembly so that the gear formed in the automatic winding apparatus is engaged with the gear of the bobbin.

The winding of the coil may include winding the coil around the bobbin while rotating the gear formed in the automatic winding apparatus.

The method may further include fixedly adhering the bobbin having the coil wound therearound, the core, and the base to one another after the winding of the coil.

According to another aspect of the present invention, there is provided a coil component manufactured through any one of the above-mentioned methods.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
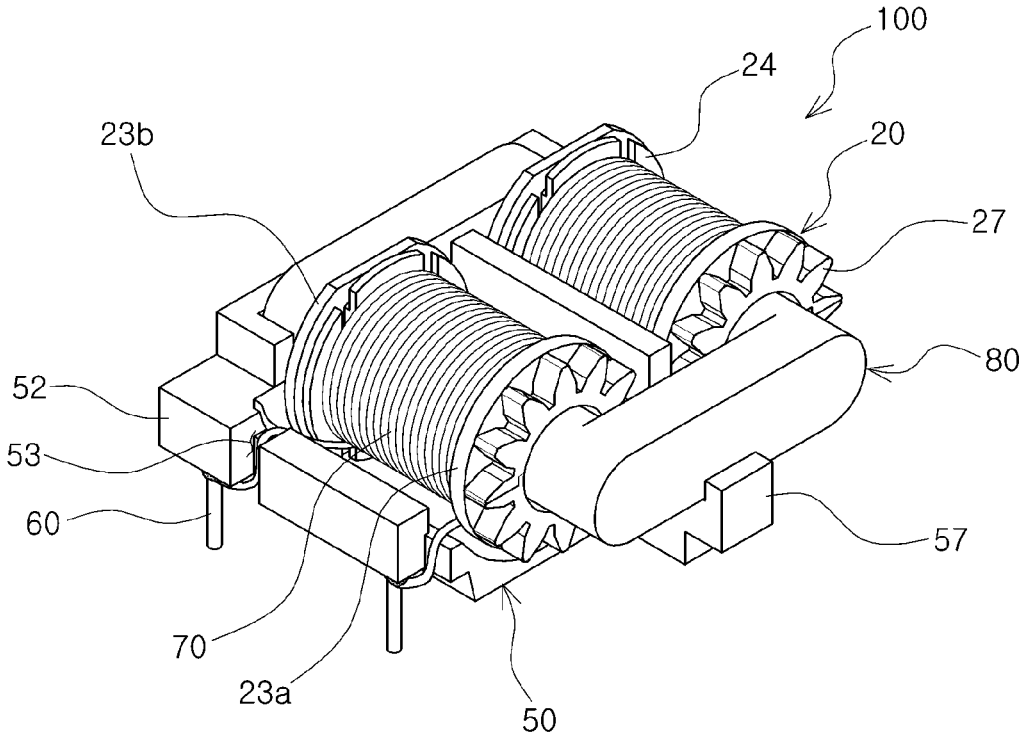
FIG. 1 is a perspective view schematically showing a line filter according to an embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe appropriately the best method he or she knows for carrying out the invention. Therefore, the configurations described in the embodiments and drawings of the present invention are merely embodiments to be implemented, but do not represent the entire technical spirit of the present invention. Thus, the present invention should be construed as including the changes, equivalents, and substitutions included in the spirit and scope of the present invention at the time of filing this application.

Hereinafter, embodiments of the present invention will be described in detail with reference to the accompanying drawings. At this time, it is noted that like reference numerals denote like elements in appreciating the drawings. Moreover, detailed descriptions related to well-known functions or configurations will be omitted in order not to unnecessarily obscure the subject matter of the present invention. Based on the same reason, it is to be noted that some components shown in the drawings are exaggerated, omitted or schematically illustrated, and the size of each component does not exactly reflect its real size.

Hereinafter, embodiments of the present invention will be described in detail with reference to the accompanying drawings.

Figure 2:
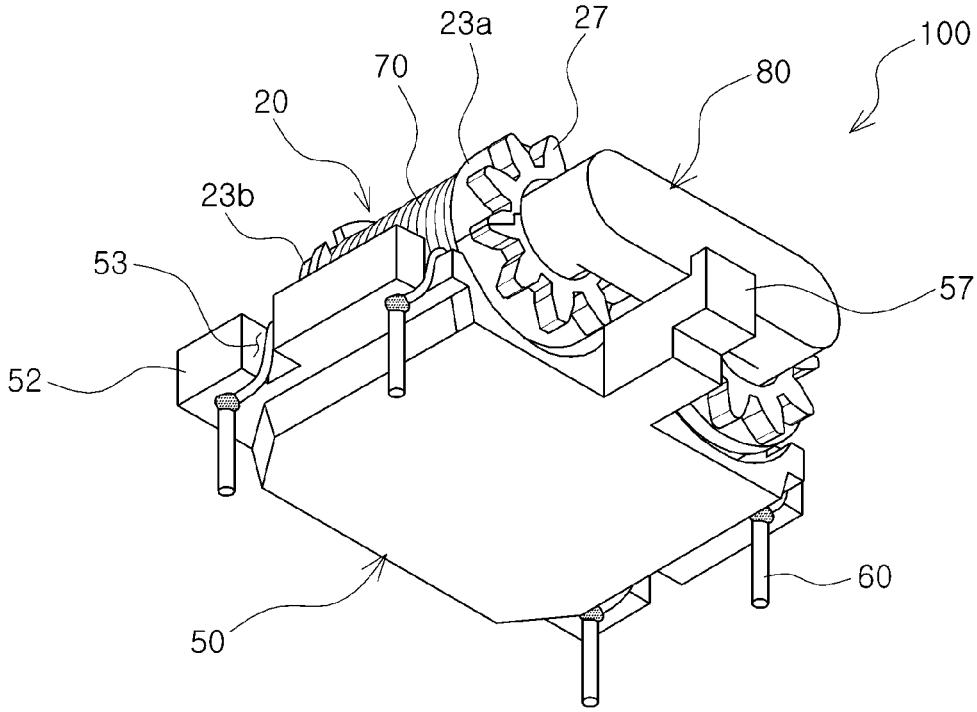
FIG. 2 is a bottom perspective view showing a bottom portion of the line filter shown in FIG. 1.
Figure 3:
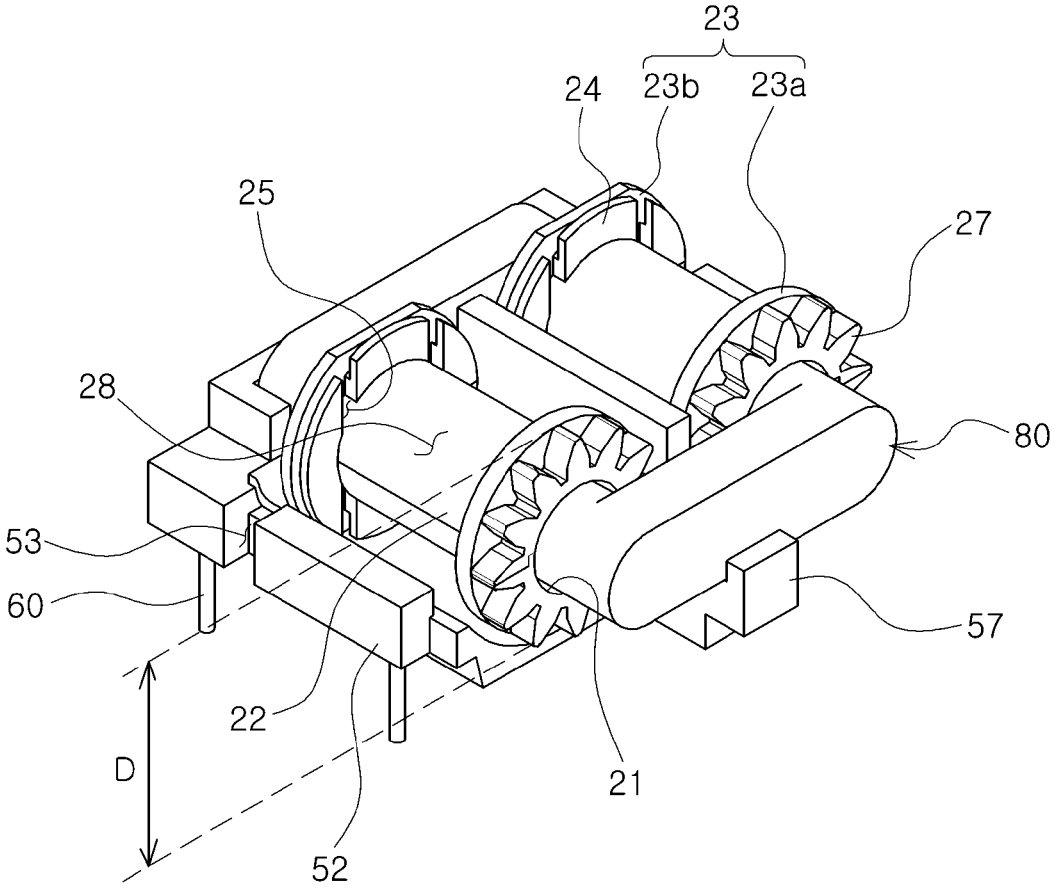
FIG. 3 is a perspective view showing the line filter shown in FIG. 1 in which the coil is omitted.
Figure 4:
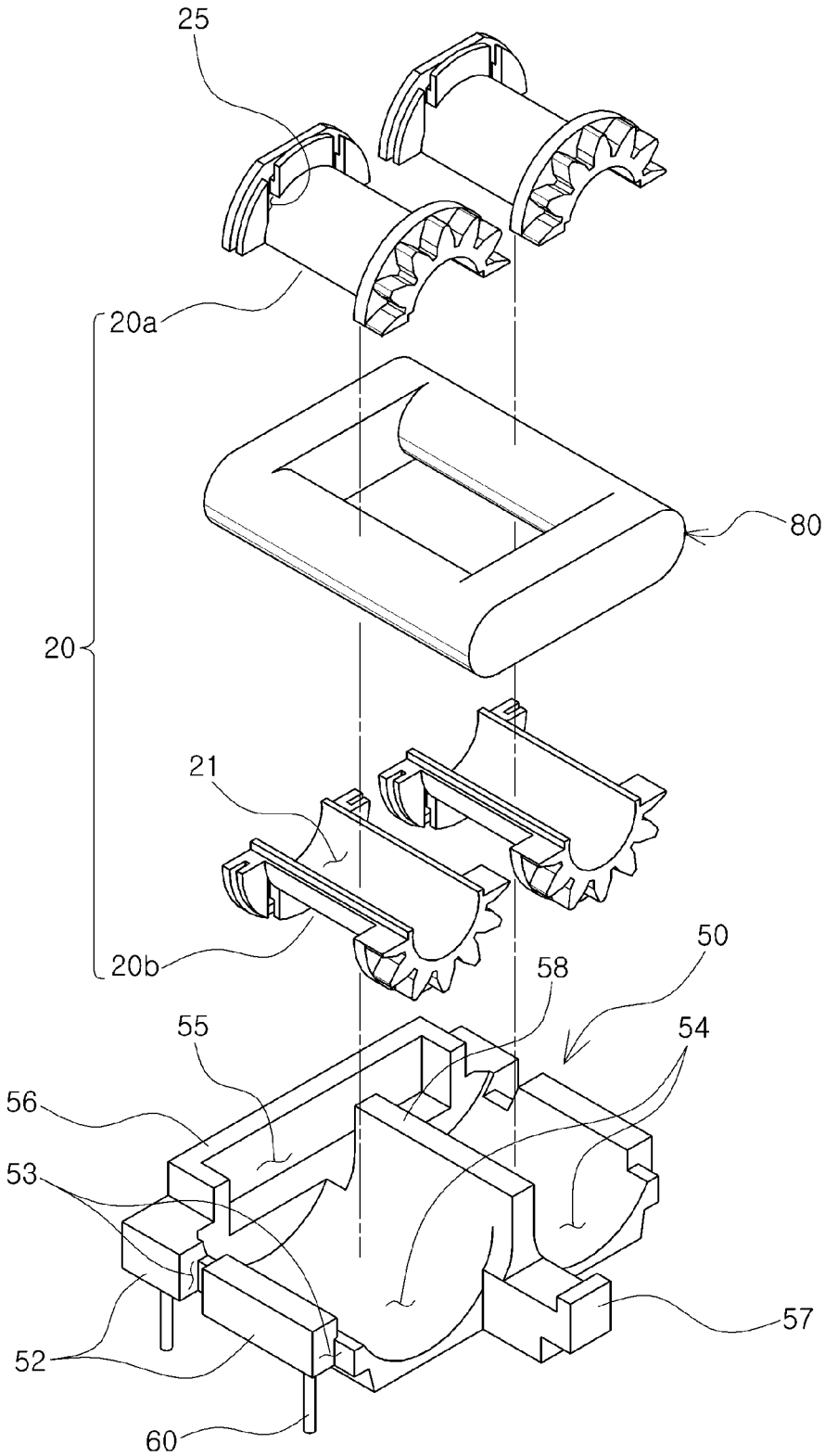
FIG. 4 is an exploded perspective view of the line filter shown in FIG. 3.

FIG. 1 is a perspective view schematically showing a line filter according to an embodiment of the present invention and FIG. 2 is a bottom perspective view showing a bottom portion of the line filter shown in FIG. 1. FIG. 3 is a perspective view showing the line filter shown in FIG. 1 in which the coil is omitted and FIG. 4 is an exploded perspective view of the line filter shown in FIG. 3.

Referring to FIGS. 1 to 4, a coil component according to an embodiment of the present invention, a line filter 100 provided for electromagnetic interference, may include a bobbin 20, a coil 70, a core 80, and a base 50.

As shown in FIG. 3, the bobbin 20 includes a tubular body part 22 having a through hole 21 formed at a center thereof and a flange part 23 formed to be vertically extend in an outer diameter direction of the body part 22 from both ends of the body part 22.

The through hole 21 formed in the inner portion of the body part 22 may be used as a path into which a portion of a core 80 to be described below is inserted. The embodiment of the present invention describes a case in which the through hole 21 has a circular cross section by way of example. This has a configuration formed according to a shape of the core 80 inserted into the through hole 21, but the embodiment of the present invention is not limited thereto. That is, the through hole 21 may be formed in various shapes corresponding to the shape of the core 80 inserted into the through hole 21.

The flange part 23 may be divided into a first flange part 23*a* and a second flange part 23*b* according to a mounted position thereof. In addition, a space formed between an outer peripheral surface of the body part 22 and the first and second flange parts 23*a* and 23*b* may be used as a winding part 28 in which a coil 70 to be described below is wound. Therefore, the flange part 23 may serve to protect the coil 70 from the outside and secure an insulation property therebetween, simultaneously with supporting the coil 70 wound around the winding part 20*a* at both sides thereof.

In addition, the line filter 100 according to the present embodiment may include a gear 27 formed on outer surface of the flange part 23 exposed to the outside of the base 50 to be described below. The gear 27 may be formed in a protrusion form protruding outwardly from the outer surface of the flange part 23 and may be formed to have a circular gear shape.

The gear 27 according to the embodiment of the present invention may be provided to automatically wind the coil 70 to be described below around the bobbin 20. This will be described in more detail in the following coil winding method.

Further, the line filter 100 according to the embodiment of the present invention may include a barrier rib 24 adjacent to the second flange part 23*b* disposed in the base 50. Further, the barrier rib 24 may be provided to have at least one insertion groove 25.

The barrier rib 24 and the insertion groove 25 may be provided to fix one end of the coil to the bobbin 20 at the time of winding the coil 70. Further, the coil winding method will be described in more detail.

As shown in FIG. 4, the bobbin 20 according to the embodiment of the present invention configured as described above may be formed by being coupled at both sides thereof based on the core 80 so that the core 80 is inserted into the through hole 21.

To this end, the bobbin 20 may be divided into a first bobbin 20*a* and a second bobbin 20*b*. The first bobbin 20*a* and the second bobbin 20*b* each show a half of the bobbin 20 formed by cutting the bobbin 20 in a longitudinal direction. Therefore, when the first bobbin 20*a* is coupled to the second bobbin 20*b*, a single completed bobbin 20 may be formed.

As described above, the bobbin 20 may be configured by being manufactured in the first bobbin 20*a* and the second bobbin 20*b* so as to be coupled to each other. The line filter 100 according to the embodiment of the present invention may be formed in an integral type in which the core 80 without the bonding surface is consecutive.

Further, two bobbins 20 according to the embodiment of the present invention may be provided, each of which is coupled to the core 80. In this case, the two bobbins 20 may be coupled to the core 80 so that the two bobbins 20 are disposed in parallel with each other.

The bobbin 20 may be easily manufactured through injection molding, but the embodiment of the present invention is not limited thereto. Therefore, the bobbin 20 may also be manufactured through various methods, such as press machining, or the like. Further, the bobbins 20 according to the present embodiment may be formed of an insulating resin material and a material having high heat resistance and high voltage resistance.

As a material of the bobbin 20, polyphenylenesulfide (PPS), liquid crystal polyester (LCP), polybutyleneterephthalate (PBT), polyethyleneterephthalate (PET), phenolic resin, and the like, may be used.

The coil 70 may be wound around the winding part 28 formed in the bobbin 20.

As the coil 70, a strand of wire may be used and a twisted wire (Ritz Wire) formed by twisting several strands may be used. Lead wires that are an end of the coil 70 may be electrically and physically connected with an external connection terminal 60 provided in the base 50 to be described below.

Meanwhile, in the line filter 100 according to the embodiment of the present invention, the coils 70 may be respectively wound around two bobbins 20 in different directions (that is, an opposite direction). For example, when the coil is wound around any one bobbin 20 clockwise, the coil may be wound around the remaining one bobbin 20 anticlockwise. However, the embodiment of the present invention is not limited thereto. Various applications such as winding the coil in an opposite direction thereto, winding the two coils in the same direction, or the like, may be implemented as necessary.

The core 80 may be inserted into the through hole 21 formed in the bobbin 20.

As described above, the bobbin 20 according to the embodiment of the present invention may be coupled to the core 80 according to the coupling of the first bobbin 20*a* and the second bobbin 20*b*. Therefore, the core 80 according to the embodiment of the present invention may be formed in a consecutively integrated type without a cut portion.

In the embodiment of the present invention, a case in which the core 80 has a rectangular shape is described by way of example. Therefore, two bobbins 20 coupled to the core 80 may be disposed to be parallel with each other. In this case, the bobbin 20 may be disposed so that the portions in which the gears 27 are formed have the same direction.

In addition, a portion of the core 80 according to the embodiment of the present invention, inserted into the through hole 21 of the bobbin 20, may be operated as a rotating shaft of the bobbin 20. Therefore, the portion inserted into the through hole 21 of the bobbin 20 may have a curved outer surface and a cylindrical outer surface so as to facilitate the rotation of the bobbin 20.

Further, as described above, two bobbins 20 may be coupled to the core 80 having a rectangular shape, and a portion of the core 80 connecting two bobbins 20 may be exposed to the outside.

Therefore, one side of the exposed portion of the core 80 according to the embodiment of the present invention may be received in a base 50, and the other side thereof connecting portions in which the gears 27 of the bobbin 20 are formed may be exposed to the outside of the base 50.

The core 80 may be formed of Mn—Zn based ferrite having relatively high permeability, relatively low loss, relatively high saturation magnetic flux density and stability, and relatively low production costs, as compared to other materials. However, in the embodiment of the present invention, a shape or a material of the core 80 is not limited thereto.

The inside of the base 50 may be provided with the core 80 to which the bobbin 20 is coupled. Therefore, the base 50 may be formed to have a structure in which a portion of the bobbin 20 may be exposed to the outside for automatic winding while the core 80 is firmly fixed thereto.

In more detail, the base 50 according to the embodiment of the present invention may include a bobbin receiving groove 54, a core receiving groove 55, a terminal fastening part 52, an external connection terminal 60, and a stumbling protrusion 57.

As shown in FIG. 4, the bobbin receiving groove 54 may be formed to have a groove form in the inside thereof, corresponding to a shape of the bobbin 20 coupled to the core 80. In the case of the embodiment of the present invention, two bobbins 20 are provided. Therefore, the bobbin receiving groove 54 may include two grooves.

Here, a blocking protrusion 58 may be formed between the two bobbin receiving grooves 54. The blocking protrusion 58 may be provided to prevent interference between the coils wound around the two bobbins 20 and secure insulation therebetween. To this end, the blocking protrusion 58 may be protruded in a form crossing the space between the bobbins 20 received in the bobbin receiving groove 54.

Meanwhile, the bobbin receiving groove 54 according to the embodiment of the present invention may be formed in a groove of which one end is open.

The open end of the bobbin receiving groove 54 may be provided with the first flange part 23*a* on which the gear 27 is formed, in the flange part 23 of the bobbin 20. As one end of the bobbin receiving groove 54 is open, the bobbin 20 disposed in the bobbin receiving groove 54 may be formed so that the gear 27 is completely exposed to the outside of the bobbin receiving groove 54.

Therefore, the other side of the core 80 exposed to the first flange part 23*a* of the bobbin 20 may be completely exposed to the outside of the base 50.

On the other hand, the second flange part 23*b* without the gear 27 in the flange part 23 of the bobbin 20 may be stably received in the bobbin receiving groove 54.

The core receiving groove 55 may be provided with one side of the core 80 to which the bobbin 20 is coupled. In detail, in the exposed portion thereof between the two bobbins 20, the portion exposed to the second flange part 23*b* may be seated therein.

To this end, the base 50 may include a side wall 56 formed therein, for forming the core receiving groove 55 therein. The side wall 56 may be formed to surround the core 80 along the shape of the core 80.

Therefore, the core 80 may be stably fixed to the inside of the base 50 by the core receiving groove 55.

The terminal fastening part 52 may be formed at the outermost edge portion of the base 50 and the inside thereof may be fastened to at least one external connection terminal 60.

The terminal fastening part 52 according to the embodiment of the present invention may be formed at both respective ends of the bobbin receiving groove 54. Therefore, the terminal fastening part 52 may be formed to be provided with a portion of the bobbin receiving groove 54.

In particular, the terminal fastening part 52 according to the embodiment of the present invention may be disposed within a range of thickness (d of FIG. 3, that is, a diameter of the flange part) range of the bobbin 20. That is, the terminal fastening part 52 may be disposed at both sides of the bobbin 20 and may be formed so as not to protrude to the top or bottom portion of the bobbin 20.

This is configured to significantly reduce the thickness of the line filter 100 according to the embodiment of the present invention. Since the terminal fastening part 52 is disposed within the thickness range of the bobbin 20, the whole thickness (that is, height) of the line filter 100 is not increased, that is, not affected by the terminal fastening part 52.

That is, the overall thickness of the line filter 100 according to the embodiment of the present invention may be determined only by a diameter (D of FIG. 3) of the bobbin 20 and a thickness of the base 50 disposed under the bobbin 20. As shown in the drawing, the base 50 disposed under the bobbin 20 is to form the bobbin receiving part 54 therein and may be formed as thin as possible when the base has rigidity capable of maintaining the shape of the bobbin receiving part 54.

Therefore, since the diameter of the bobbin 20 actually form the whole thickness, the line filter 100 according to the embodiment of the present invention may be relatively very thinly formed even in a case in which the line filter 100 includes the base 50 and the terminal fastening part 52.

In addition, the terminal fastening part 52 according to the embodiment of the present invention may have at least one lead groove 53 formed thereon. The lead groove 53 may be provided to guide the end of the coil 70 wound around the bobbin 20, that is, lead wires to the external connection terminal 60.

The lead wires of the coil 70 may stably lead to the external connection terminal 60 by the lead groove 53. Further, the motion of the lead wires may be suppressed due to the insertion of the lead wires into the lead groove 53.

Therefore, after the lead wires are fastened to the external connection terminal 60, the lead wires may be prevented from moving thereof due to the external force and thus being separated from the external connection terminal 60.

The external connection terminal 60 may protrude to the outside from the terminal fastening part 52 to thus be fastened thereto.

The embodiment of the present invention describes, by way of example, the case in which the external connection terminal 60 protrudes downwardly from the terminal fastening part 52.

However, the embodiment of the present invention is not limited thereto. That is, the external connection terminal 60 may be fastened thereto, to horizontally protrude from the terminal fastening part 52, or may be formed to be bent at a portion thereof.

In addition, as shown in FIG. 2, the base 50 according to the embodiment of the present invention may include four external connection terminals 60. This is because the line filter 100 according to the embodiment of the present invention is configured to include two coils 70. Therefore, the coil component according to the embodiment of the present invention is not limited thereto and may include the external connection terminals 60 of the number corresponding to the number of the included coils 70.

The stumbling protrusion 57 is provided to support the core 80.

The stumbling protrusion 57 may be formed to be protruded from a side of the base, and in more detail, from one end of an open portion of the bobbin receiving groove 54.

The stumbling protrusion 57 may be partially protruded along a horizontal direction from the base 50 and an edge thereof may be formed to have a hook shape protruded toward the top portion of the base 50.

The stumbling protrusion 57 may be formed at an opposite side of the core receiving groove 55 described above. Therefore, in the exposed portion of the core 80 exposed between the bobbins 20, the stumbling protrusion 57 may support the portion of the core exposed to the first flange part 23*a* of the bobbin 20 side, that is, exposed to the gear 27 side.

The stumbling protrusion 57 may support a center of the exposing portion of the core 80 so as to stably support the core 80. To this end, the stumbling protrusion 57 may be formed to protrude between the two bobbin receive grooves 54.

The line filter 100 according to the present embodiment as described above may be configured to be appropriated for an automated manufacturing method.

That is, the line filter 100 according to the embodiment of the present invention may wind the coil 70 around the bobbin 20 by using a separate automatic winding apparatus 90 in a state in which the bobbin 20, the core 80, and the base 50 are coupled together.

Hereinafter, a method of manufacturing a coil component according to an embodiment of the present invention will be described. Through the following description, the configuration of the above-mentioned line filter 100 will be explicitly described.

FIGS. 5A to 5F are perspective views for explaining a method of manufacturing a line filter shown in FIG. 1.

Figure 5A:
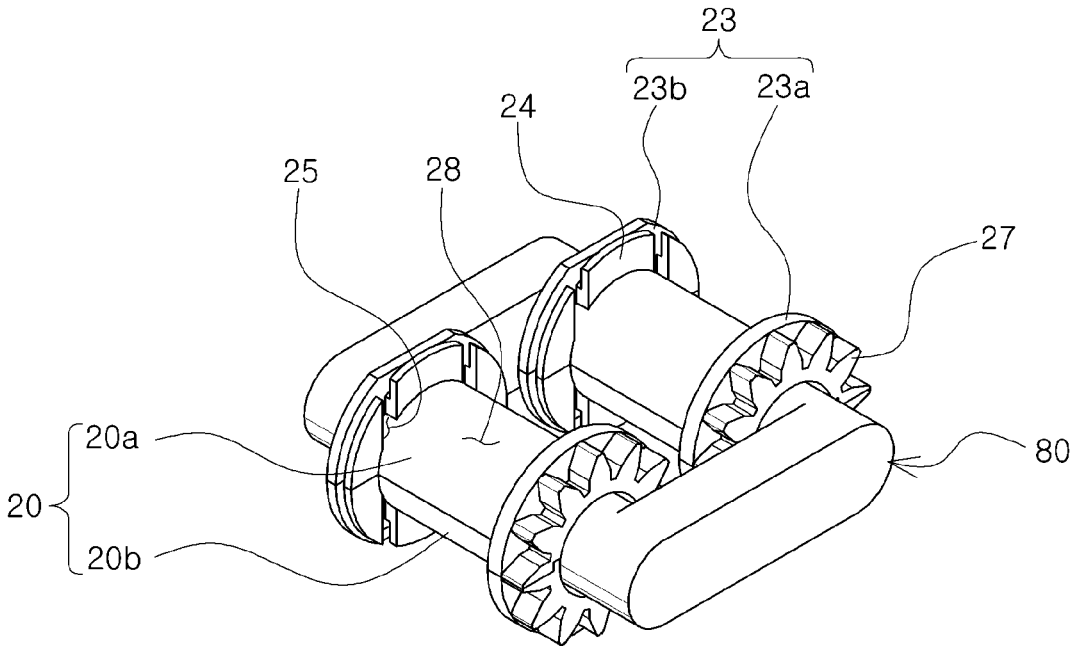
FIGS. 5A to 5F are perspective views for explaining a method of manufacturing a line filter shown in FIG. 1.

Referring to FIG. 5A, in the method of manufacturing the line filter 100 according to the embodiment of the present invention, the bobbins 20 may be first coupled to the integrally formed core 80.

As described above, the bobbin 20 may be coupled to the core 80 by assembling the first bobbin 20*a* and the second bobbin 20*b* with each other, having the core 80 disposed therebetween. In this case, the bobbin 20 may be rotatably coupled to the core 80, based on the core 80 as the rotating shaft.

Figure 5B:
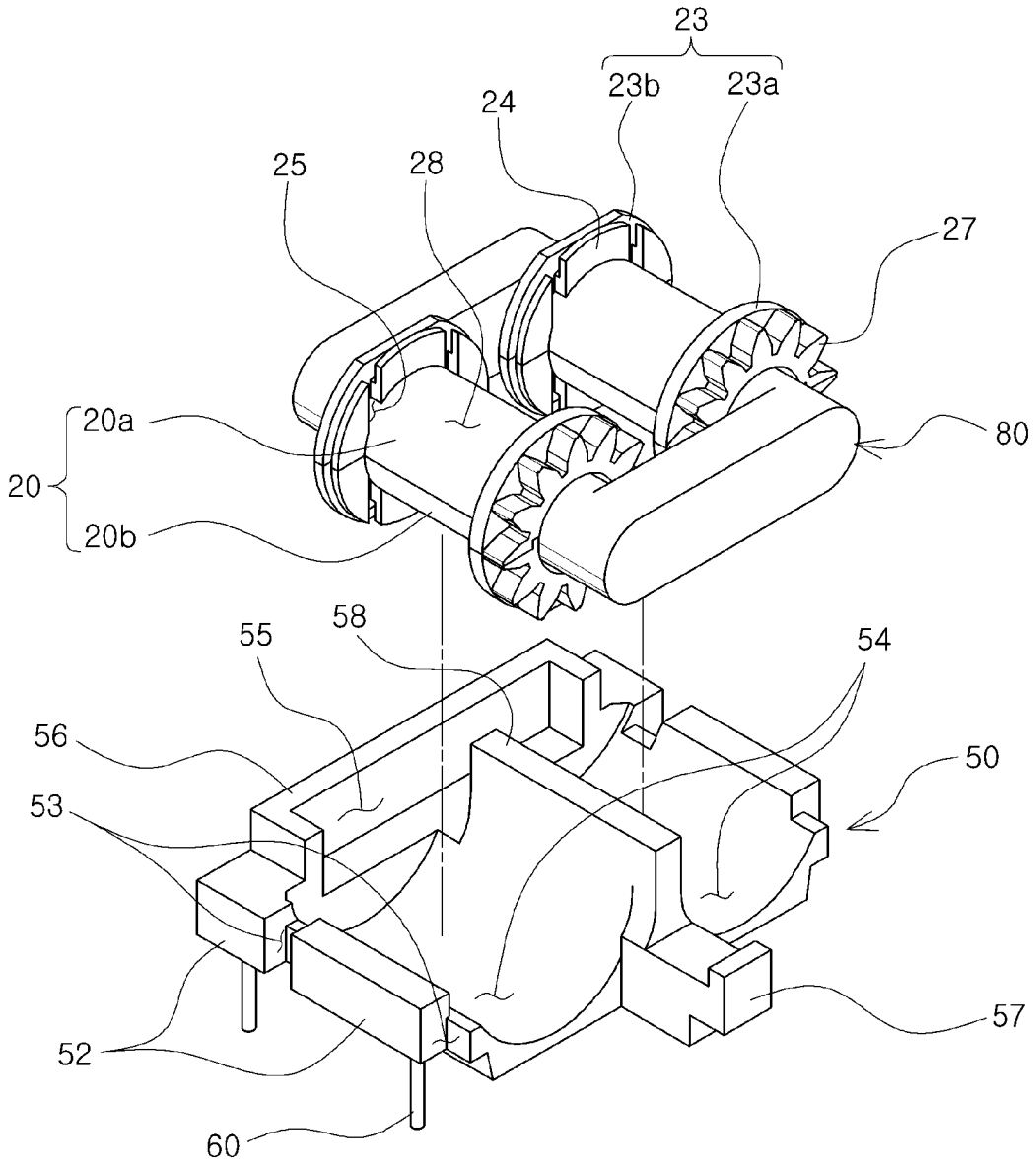

Next, as shown in FIG. 5B, the core 80 coupled to the bobbin 20 may be coupled to the base 50. In this case, an adhesive may be interposed at a portion between the base 50 and the core 80 in contact with each other, as necessary. Therefore, before the core 80 is coupled, an adhesive may be applied to the inside of the core receiving groove 55, the inside of the stumbling protrusion 57, or the like.

However, the embodiment of the present invention is not limited thereto. In a case in which coupling force between the core 80 and the base 50 is sufficient, the adhesive may be omitted in the process.

Meanwhile, the bobbin 20 needs to be rotatably maintained even in a case in which the core 80 is coupled to the base 50. Therefore, a bonding member such as an adhesive is not interposed between the bobbin 20 and the base 50.

When the bobbin 20, the core 80, and the base 50 are coupled to one another through the above-mentioned process, winding the coil around the bobbin 20 may be performed. Here, the process may be performed by a separate automatic winding apparatus.

Figure 5C:
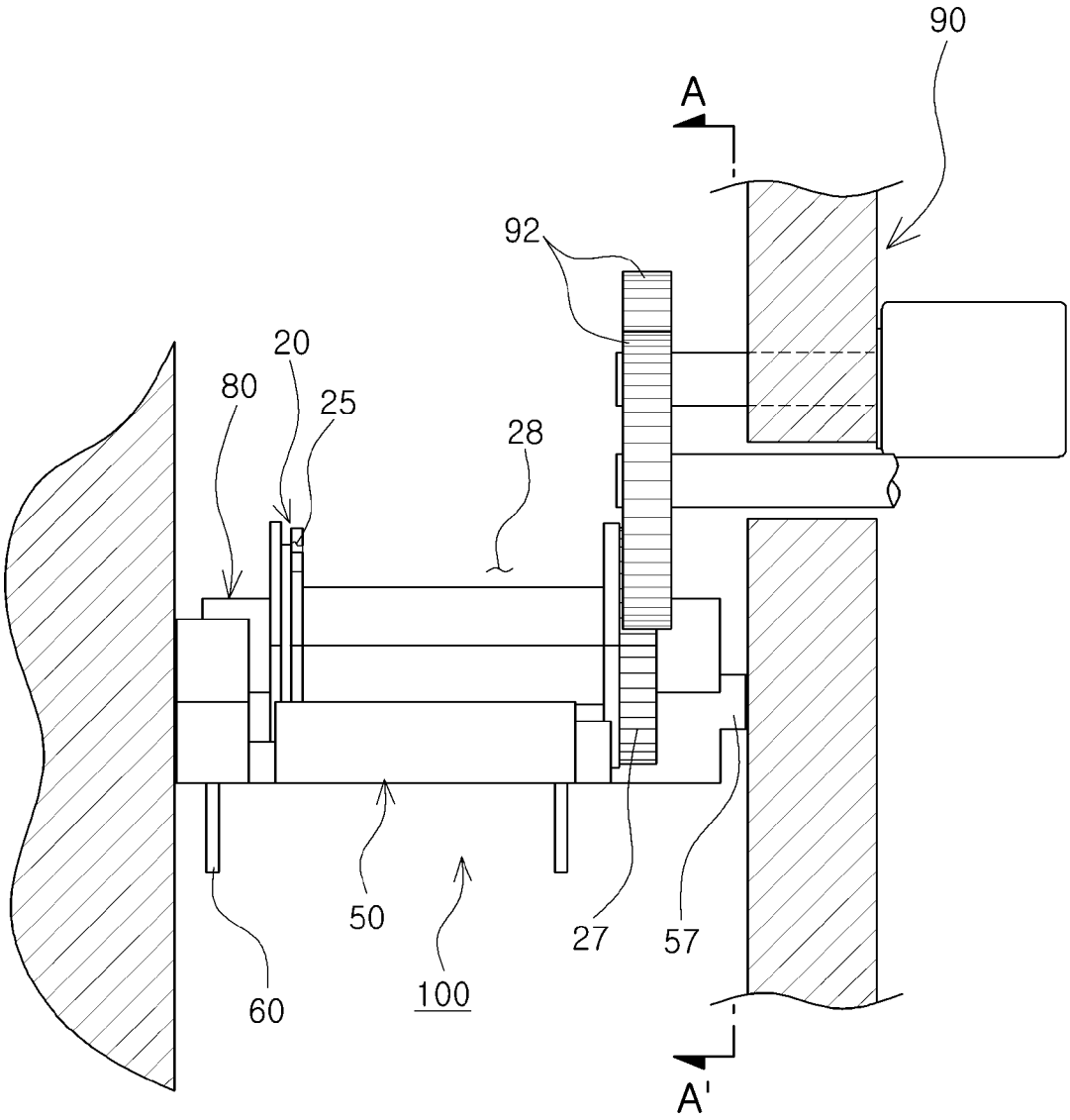
Figure 5D:
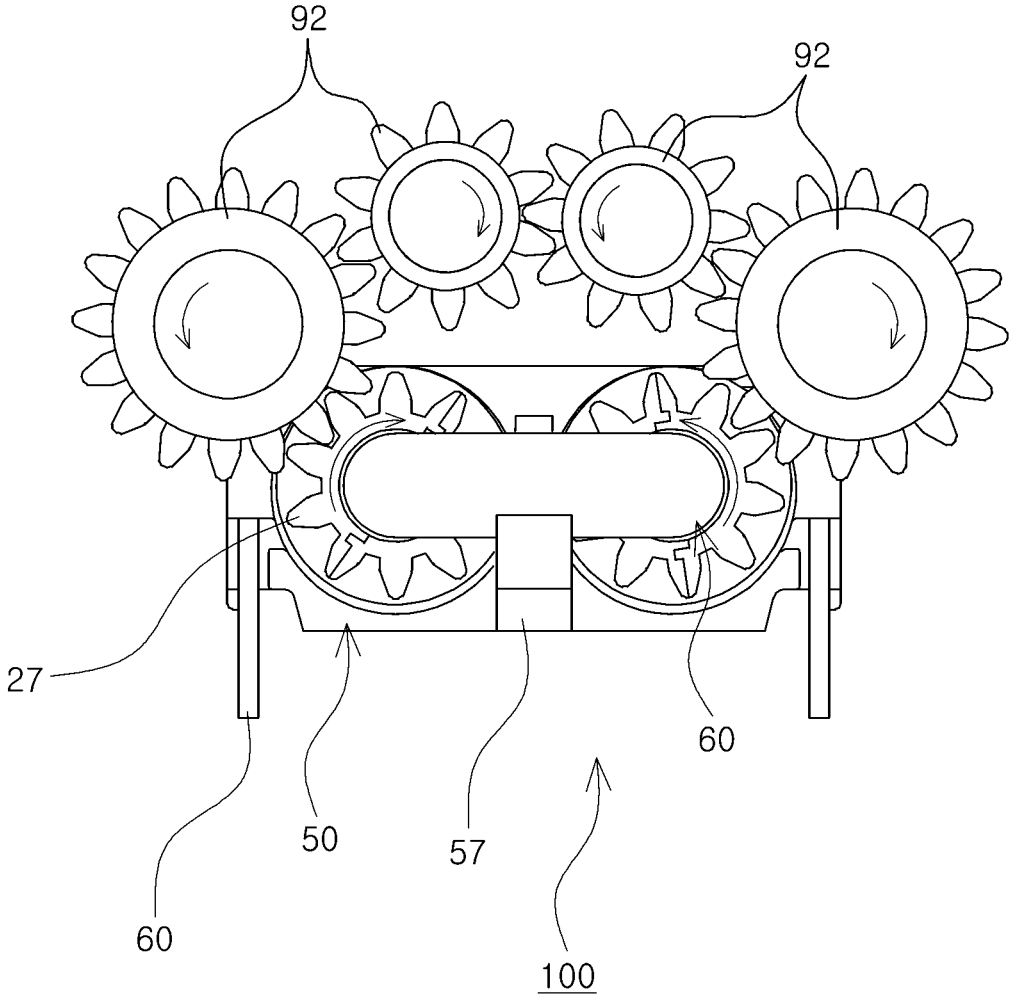

As shown in FIGS. 5C and 5D, the assembly in which the bobbin 20, the core 80, and the base 50 are coupled to one another may be disposed in the automatic winding apparatus 90. Further, the assembly is fixed within the automatic winding apparatus 90 by pressing both ends of the assembly. Here, FIG. 5D shows a cross section taken along line A-A' of FIG. 5C.

During the process, the gear 27 of the bobbin 20 may be engaged with a gear 92 protruded in the automatic winding apparatus 90.

Meanwhile, the gear 92 of the automatic winding apparatus 90 may be variously formed as necessary. The embodiment of the present invention describes, by way of example, the case in which the coil 70 is simultaneously wound around the two bobbins 20 in an opposite direction to each other. To this end, the automatic winding apparatus 90 according to the embodiment of the present invention may include four gears 92. In this case, when rotating force is applied to any one of the two gears 92 disposed on an upper portion, the remaining gears 92 and the bobbins 20 engaged therewith may rotate together.

However, the embodiment of the present invention is not limited thereto but may be variously applied. For example, the two bobbins 20 may be configured to rotate in the same direction by using three or five gears. In this case, respective bobbins 20 may be wound with the coil 70 in the same direction.

In addition, the line filter 100 according to the embodiment of the present invention may be formed to have a form in which both sides of the bobbin 20 and the top thereof are open. Therefore, the gear 92 of the automatic winding apparatus 90 may be coupled to the gear 27 of the bobbin 20 even in both sides of the bobbin 20 and the top portion of the bobbin 20. Therefore, the gears 92 of the automatic winding apparatus 90 may be disposed at various positions in various forms, as necessary.

Figure 5E:
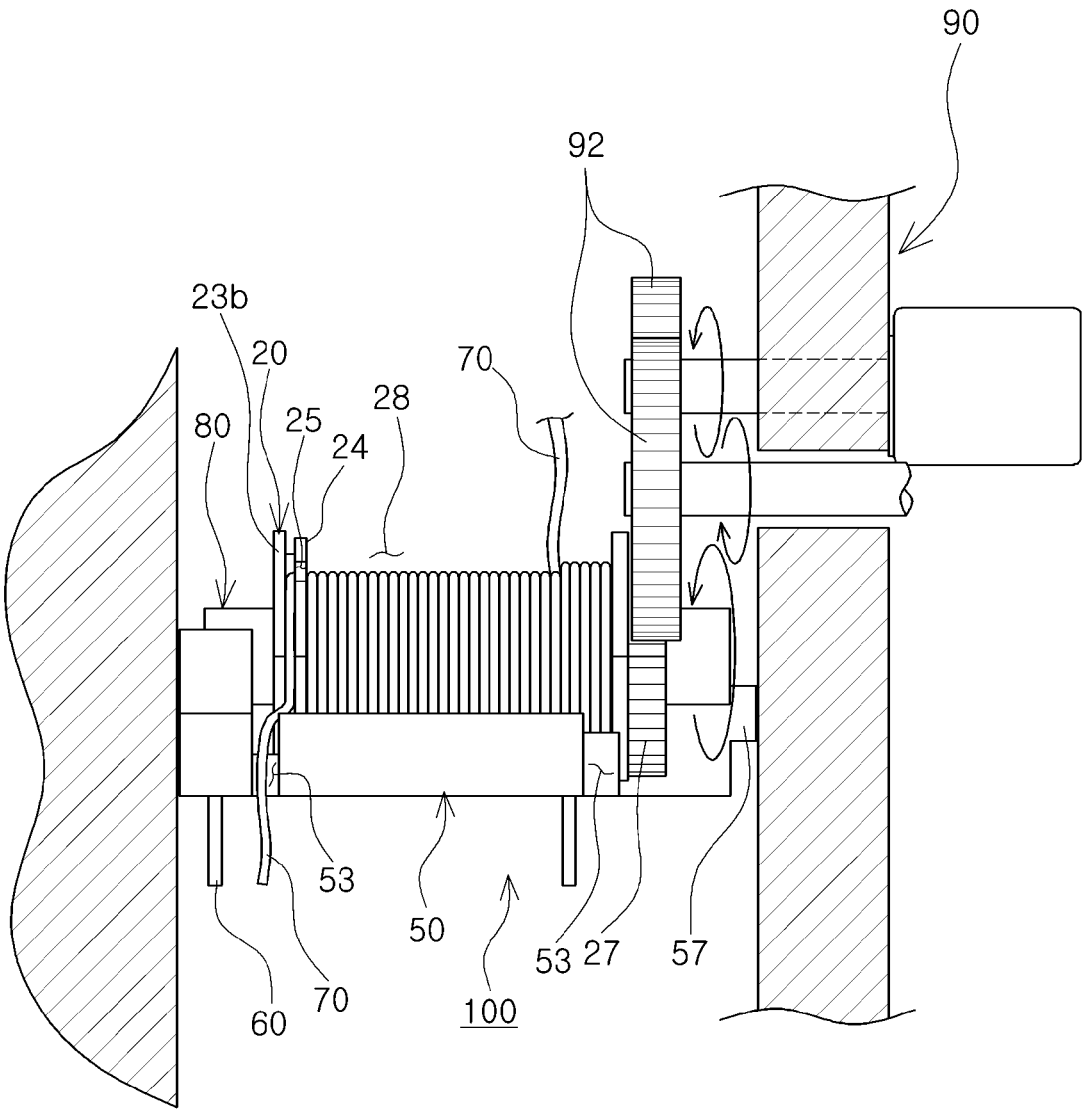

Next, as shown in FIG. 5E, after the coil 70 is fixed to the bobbin 20, the coil 70 may be wound around the bobbin 20 by rotating the bobbin 20. The coil 70 may be inserted into a space between the second flange part 23*b* of the bobbin 20 and the barrier rib 24, to be fixed to the bobbin 20. In addition, the winding part 28 of the bobbin 20 may be drawn out through the insertion groove 25 formed in the barrier rib 240 so as to be wound around the winding part 28.

The winding of the coil 70 may be performed by rotating the gear 92 of the automatic winding apparatus 90. That is, when the gear 92 of the automatic winding apparatus 90 is connected with a driving device such as a motor, or the like, and is rotated, the gear 27 of the bobbin 20 engaged with the gear 92 of the automatic winding apparatus 90 may be rotated together. Therefore, each bobbin 20 may be rotated based on the core 80 as the rotating shaft, and thus, the winding part 28 of the bobbin 20 may be wound with the coil 70.

As described above, the line filter 100 according to the embodiment of the present invention may be maintained in a state in which the top portion of the bobbin 20, that is, both sides and the top portion of the winding part 28 are open, so as to facilitate the winding of the coil 70. Further, the gear 27 of the bobbin 20 may be exposed to the outside as maximally as possible so that the gear 27 of the bobbin 20 is smoothly engaged with the gear 92 of the automatic winding apparatus 90.

Therefore, the gear 92 of the automatic winding apparatus 90 may be easily engaged with the gear 27 of the bobbin 20 even in the state in which the bobbin 20, the core 80, and the base 50 are coupled together, such that the coil 70 may be relatively easily wound around the bobbin 20.

Figure 5F:
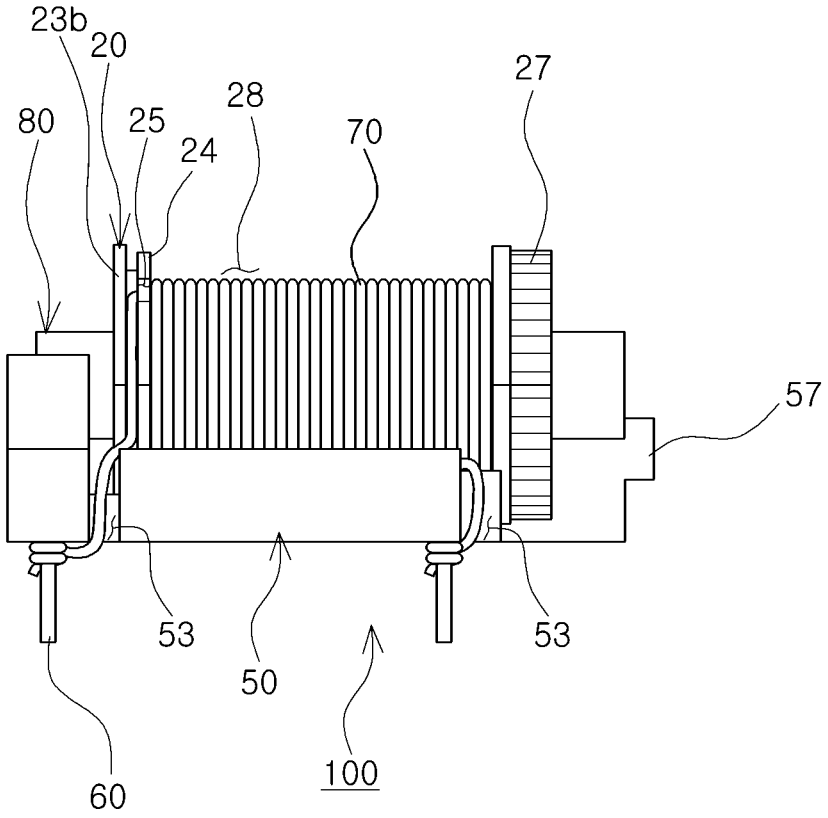

When the winding of the coil 70 is completed, as shown in FIG. 5F, the end of the coil 70, that is, the lead wires are fastened to the external connection terminals 60. That is, the lead wires of the coil 70 may be drawn out to the bottom portion of the base 50 through the corresponding lead groove 53 and each lead wire may be wound around a corresponding external connection terminal 60 to be connected thereto at the bottom portion of the base 50. Thereafter, bonding the lead wires to the external connection terminals 60 by using melting solder, or the like, may be further performed, as necessary.

In addition, fixedly bonding the bobbin 20 to the base 50 by using resin, varnish, or the like, therebetween may be further performed. The bonding may be performed by impregnating the line filter 100 in a solution in which resin, varnish, or the like, is contained. However, the embodiment of the present invention is not limited thereto. That is, various methods such as injecting resin or varnish, spraying resin or varnish in a spray type, or the like, between the bobbin 20 and the base 50 may be used.

Through the process, the bobbin 20 around which the coil 70 is wound may be firmly fixed to the core 80 and the base 50 so as not to move. Therefore, the line filter 100 according to the embodiment of the present invention may be completed.

As set forth above, in the method of manufacturing a coil component according to the embodiment of the present invention, the coil may be wound in the state in which the bobbin, the core, and the base are assembled together. Therefore, the coil component may be manufactured only by the process of assembling the bobbin, the core, and the base and the process of connecting the coil wound around the bobbin with the external connection terminal.

Therefore, the line filter according to the embodiment of the present invention may be easily manufactured, as compared with the method of first winding the coil around the bobbin, assembling the coil with the base, and connecting the coil with the external connection terminal.

Further, since the coil may be automatically wound around the bobbin, the time required to wind the coil may be reduced, thereby shortening a manufacturing time.

As described above, most of processes of manufacturing the coil component according to the present invention may be automated. Therefore, the costs and time required for manufacturing the coil component may be significantly reduced.

In addition, the coil component according to the embodiment of the present invention may be formed to have a form in which the bobbin is completely exposed to the outside from the base. Therefore, the bobbin may be easily engaged with the gear of the automatic winding apparatus even in the state in which the bobbin is coupled to the core and the base, thereby facilitating the winding of the coil.

In addition, in the method of manufacturing a coil component according to the embodiments of the present invention, the coil may be formed to have a thickness approximately meeting a diameter of the bobbin. Therefore, the thickness of the coil may be significantly reduced, and thus, the coil may be relatively easily used for slim electronic devices.

Meanwhile, as described above, the line filter according to the embodiment of the present invention, a horizontal mounting type, may have a shape suitable for the thin electronic devices.

However, the coil component according to the embodiment of the present invention is not limited to the above-mentioned embodiment, but may be variously applied. The coil component according to the embodiment of the present invention to be described below may be formed to have a similar structure to the coil component 100 (FIG. 1) of the above-mentioned embodiment of the present invention and has a difference only in the structure of the base. Accordingly, a detailed description of the same components will be omitted, and the structure of the base will be mainly described in detail. In addition, the same reference numerals will be used to describe the same components as those of the above-mentioned embodiment.

Figure 6:
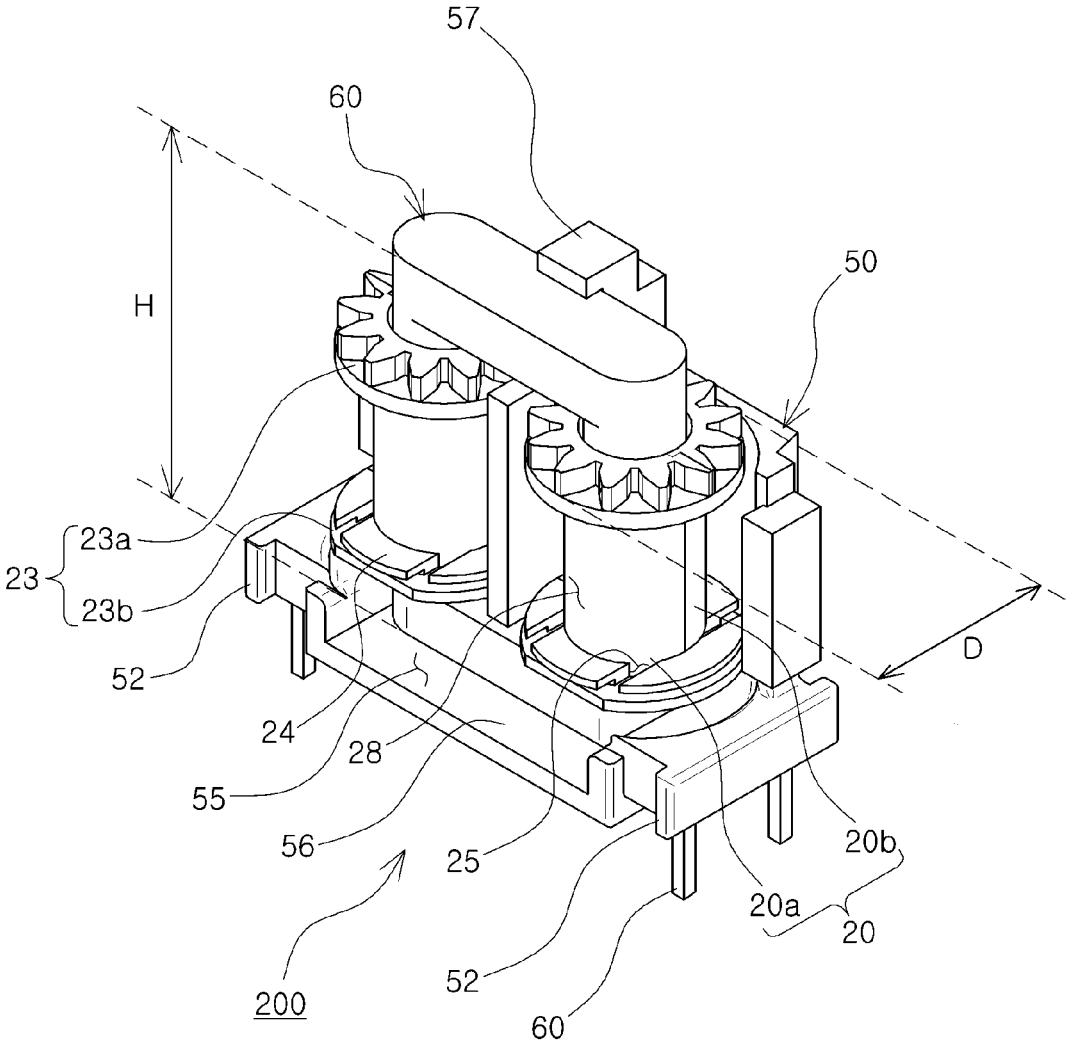
FIG. 6 is a perspective view schematically showing a line filter according to another embodiment of the present invention.
Figure 7:
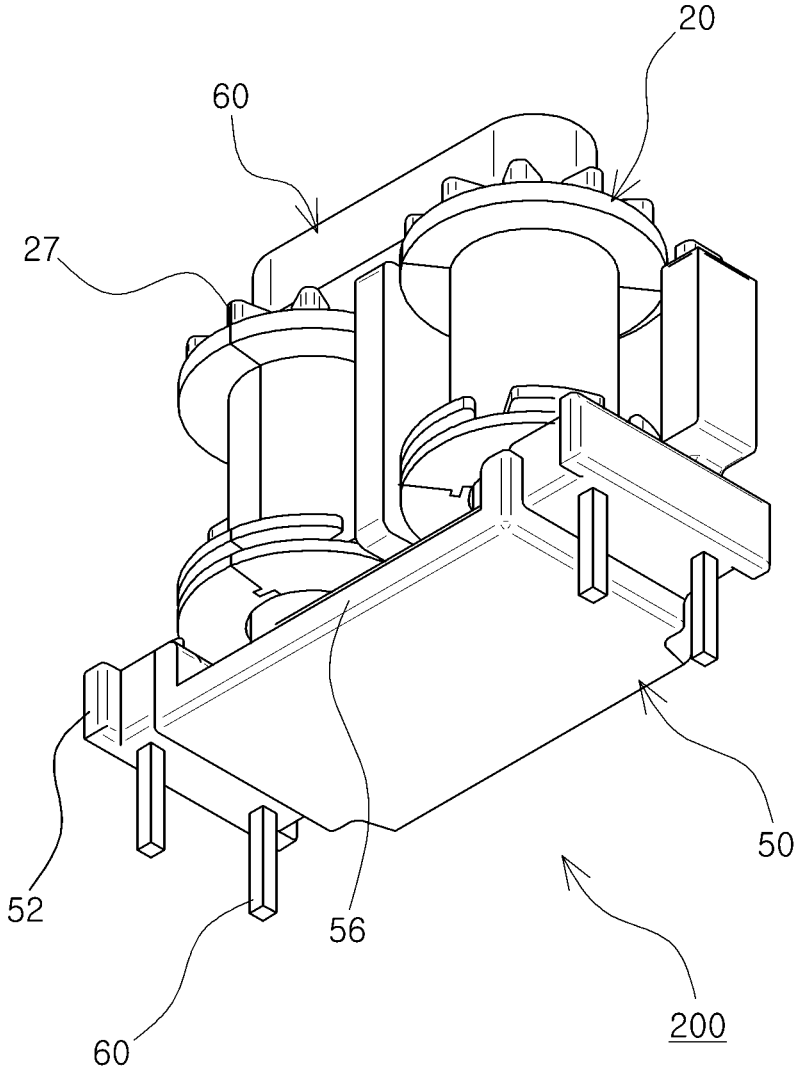
FIG. 7 is a bottom perspective view of the line filter shown in FIG. 6.

FIG. 6 is a perspective view schematically showing a line filter according to another embodiment of the present invention and FIG. 7 is a bottom perspective view of the line filter shown in FIG. 6.

Referring to FIGS. 6 and 7, the coil component according to the embodiment of the present invention may include the bobbin 20, the coil (not shown), the core 80, and the base 50, similar to the above-mentioned embodiment of the present invention.

The coil component according to the embodiment of the present invention may be a vertical mounting type line filter 200 that may be easily used for electronic devices having a relatively high height and a relatively narrow width. Therefore, the bobbin 20 and the core 80 may be coupled to the base 50 in a form in which the longitudinal direction thereof is vertical to a substrate (not shown) on which the line filter is mounted.

Here, the configuration of the bobbin 20, the coil, and the core 80 may be identical to the above-mentioned embodiments of the present invention and thus, a detailed description thereof will be omitted.

The base 50 according to the embodiment of the present invention is formed to have a structure similar to the base 50 (FIG. 3) according to the embodiment of the present invention, and has a difference in a position of the terminal fastening part 52. In more detail, the terminal fastening part 52 of the base 50 may be formed to have a form in which it protrudes to the outside from the side wall 56 of the core receiving groove 55.

As the line filter 200 according to the embodiment of the present invention is formed in a vertical mounting type, the side wall 56 of the core receiving groove 55 may be disposed under the line filter 200. Therefore, the terminal fastening part 52 may be protruded from the side wall 56 that is located to be adjacent to the substrate (not shown).

In this case, similar to the above-mentioned embodiment of the present invention, in order to significantly reduce the thickness (or width) of the line filter 200, the terminal fastening part 52 according to the embodiment of the present invention may be disposed within the thickness range (D of FIG. 6, that is, the diameter of the flange part of the bobbin) of the bobbin 20.

Therefore, in the line filter 200 according to the embodiment of the present invention, the diameter D of the bobbin 20 actually forms the whole thickness (or width). Therefore, even in a case in which the line filter includes the base 50 and the terminal fastening part 52, the thickness (or width) may be relatively very thin.

Further, the terminal fastening part 52 may be disposed within a vertical range (H) of the core 80. That is, the bottom surface of the terminal fastening part 52 may be disposed at a higher position than the bottom surface of the core 80. Therefore, the terminal fastening part 52 may be configured so as not to be protruded to the bottom portion of the bobbin 20, such that the whole height of the line filter 200 may be prevented from increasing due to the terminal fastening part 52.

Therefore, the whole height of the line filter 200 according to the embodiment of the present invention may be determined by the length of the core 80 and therefore, the size thereof may be significantly reduced even in a case in which the line filter 200 includes the base 50.

Meanwhile, the coil component and the method of manufacturing the same according to the present invention described above are not limited to the above-mentioned embodiments, but may be variously applied. For example, the above-mentioned embodiments of the present invention describe, by way of example, the case in which two bobbins are disposed in parallel with each other along the horizontal surface, but the embodiments of the present invention are not limited thereto. That is, the bobbins are disposed in parallel with each other along the vertical surface or may be variously configured such as the case in which only one bobbin is used.

In addition, the embodiments of the present invention describe, by way of example, the line filter used for the power supply device, but the embodiments of the present invention are not limited thereto. Therefore, the coil component manufactured through wining the coil around the bobbin may be widely applied to various electronic components and electronic devices.

As set forth above, according to the coil component and the method of manufacturing the same according to the embodiments of the present invention, the coil may be wound in a state in which the bobbin, the core, and the base are assembled together. Therefore, the line filter may be manufactured only by the process of assembling the bobbin, the core, and the base and the process of connecting the coil wound around the bobbin with the external connection terminal.

Therefore, the line filter may be easily manufactured, as compared with the method of first winding the coil around the bobbin, assembling the coil with the base, and connecting the coil with the external connection terminal.

In addition, the coil component according to the embodiments of the present invention has a form in which the bobbin is completely exposed to the outside from the base. Therefore, the bobbin may be easily engaged with the gear of the automatic winding apparatus even in the state in which the bobbin is coupled to the core and the base, thereby facilitating the winding of the coil.

In addition, in the method of manufacturing a coil component according to the embodiment of the present invention, the coil may be automatically wound around the bobbin to reduce the time required to wind the coil, thereby shortening a manufacturing time.

Therefore, most of processes of manufacturing the line filter according to the embodiments of present invention may be automated, which results in significantly reducing costs and time required for manufacturing the line filter.

In addition, in the method of manufacturing a coil component according to the embodiments of the present invention, the thickness of the coil may have a size approximately meeting a diameter of the bobbin. Therefore, the thickness of the coil may be significantly reduced and thus, the coil may be easily used for slim electronic devices.

While the present invention has been shown and described in connection with the embodiments, it will be apparent to those skilled in the art that modifications and variations may be made without departing from the spirit and scope of the invention as defined by the appended claims.

What is claimed is:

1. A coil component, comprising:

a core;

at least one bobbin coupled to the core and having a coil wound therearound; and a base having the core seated therein and including an external connection terminal, one side of the core being seated in the base and the other side thereof being exposed to the outside of the base, wherein the bobbin includes a tubular body part having a through hole formed therein; and flange parts protruding to the outside from both ends of the body part, wherein an outer surface of any one of the flange parts is provided with a gear and the gear is exposed to the outside of the base, wherein the base includes a core receiving groove in which one side of the core is seated;

a bobbin receiving groove in which the bobbin is received; and a stumbling protrusion protruded from an opposite side of the core receiving groove to support the other side of the core.

2. The coil component of claim 1, wherein when the bobbin is received in the bobbin receiving groove, the flange part formed with the gear is exposed to the outside of the base.

3. The coil component of claim 1, wherein the base includes a terminal fastening part formed at an outer edge and fastened to the external connection terminal.

4. The coil component of claim 3, wherein the terminal fastening part includes at least one lead groove guiding the coil to the external connection terminal.

5. The coil component of claim 3, wherein the terminal fastening part is disposed within a vertical range formed by a diameter of the bobbin.

6. The coil component of claim 1, wherein the base includes:

a side wall forming an outer contour of the core receiving groove; and a terminal fastening part formed at the outside of the side wall and fastened to the external connection terminal.

7. The coil component of claim 6, wherein the terminal fastening part is disposed within a horizontal range formed by a diameter of the bobbin.

8. The coil component of claim 1, wherein two of the bobbins are coupled to the core, and the base is formed with two bobbin receiving grooves corresponding to the two bobbins.

9. The coil component of claim 8, wherein the base includes a blocking protrusion protruded while crossing the bobbins between the two bobbin receiving grooves.

10. The coil component of claim 8, wherein the stumbling protrusion supports a center of the other side of the core exposed between the two bobbins.

11. A coil component, comprising:

a core;

at least one bobbin coupled to the core, having a coil wound therearound, and a gear formed at one end thereof; and a base having the core seated thereon and including a terminal fastening part fastened to an external connection terminal, the bobbin being disposed so that the gear is exposed to the outside of the base and the terminal fastening part is disposed within a vertical range formed by a diameter of the bobbin, wherein the base includes a core receiving groove in which one side of the core is seated;

a bobbin receiving groove in which the bobbin is received; and a stumbling protrusion protruded from an opposite side of the core receiving groove to support the other side of the core.

12. A coil component, comprising:

a core;

at least one bobbin coupled to the core and including a winding part having a coil wound therearound and a gear formed at one end of the winding part; and a base including a bobbin receiving groove receiving the winding part and the other end of the bobbin, wherein the base includes a core receiving groove in which one side of the core is seated; and a stumbling protrusion protruded from an opposite side of the core receiving groove to support the other side of the core.

* * * * *